US011248196B2

(12) United States Patent
Neto et al.

(10) Patent No.: US 11,248,196 B2
(45) Date of Patent: Feb. 15, 2022

(54) DETERGENT COMPOSITION IN EFFERVESCENT TABLET FORM

(71) Applicant: WASH TO GO, Unipessoal Lda., Freguesia de Cantanhede e Pocarica (PT)

(72) Inventors: Sergio de Magalhães Neto, Sao Paulo (BR); Gabriella de Oliveira Santos Ribeiro, Sao Bernardo do Campo (BR)

(73) Assignee: EQUITY DESIGN DESENVOLVIMENTO DE PROCESSOS E PRODUTOS LTDA., Sao Paulo (BR)

( * ) Notice: Subject to any disclaimer, the term of this patent is extended or adjusted under 35 U.S.C. 154(b) by 0 days.

(21) Appl. No.: 16/791,087

(22) Filed: Feb. 14, 2020

(65) Prior Publication Data

US 2020/0181545 A1 Jun. 11, 2020

Related U.S. Application Data

(63) Continuation-in-part of application No. 16/009,493, filed on Jun. 15, 2018, now Pat. No. 10,711,229.

(60) Provisional application No. 62/519,925, filed on Jun. 15, 2017.

(51) Int. Cl.

| | |
|---|---|
| ***C11D 17/00*** | (2006.01) |
| ***C11D 3/10*** | (2006.01) |
| ***C11D 1/14*** | (2006.01) |
| ***C11D 3/20*** | (2006.01) |
| ***C11D 3/34*** | (2006.01) |
| ***C11D 3/37*** | (2006.01) |
| ***C11D 3/386*** | (2006.01) |
| ***C11D 3/50*** | (2006.01) |
| ***C11D 3/30*** | (2006.01) |

(52) U.S. Cl.

CPC ..... *C11D 17/0047* (2013.01); *C11D 1/14* (2013.01); *C11D 3/10* (2013.01); *C11D 3/2079* (2013.01); *C11D 3/2086* (2013.01); *C11D 3/30* (2013.01); *C11D 3/349* (2013.01); *C11D 3/3418* (2013.01); *C11D 3/3707* (2013.01); *C11D 3/386* (2013.01); *C11D 3/50* (2013.01)

(58) Field of Classification Search

CPC ... C11D 17/0047; C11D 17/0073; C11D 3/50; C11D 3/10

See application file for complete search history.

*Primary Examiner* — Khanh T Nguyen

(74) *Attorney, Agent, or Firm* — Warshaw Burstein, LLP; John C. Laurence

(57) ABSTRACT

An effervescent detergent tablet comprising sodium laureth sulfate, citric acid, sodium bicarbonate, fragrance, Stepantex VT 90 (Methyl bis[ethyl (tallowate)]-2-hydroxyethyl ammonium methyl sulfate), polyhexamethylene biguanide (PHMB), silicon dioxide, enzymes mix, Long Brite (Disodium Distyrylbiphenyl Disulfonate), Stearic Acid, Nabion 15 (Carbon-Disilicate co-granulate) and Polyethylene glycol 4000.

6 Claims, 2 Drawing Sheets

DETERGENT COMPOSITION IN EFFERVESCENT TABLET FORM

PRIORITY CLAIM

This application is based upon and claims the benefit of priority from U.S. patent application Ser. No. 16/009,493, filed on Jun. 15, 2018, which claims priority to U.S. provisional patent application Ser. No. 62/519,925, filed Jun. 15, 2017 the entire contents of both are incorporated herein by reference.

FIELD OF THE INVENTION

This disclosure relates generally an effervescent tableted portable detergent comprising of detergent, softener, microbial and enzymatic technology containing active oxygen which make rising of clothing after washing unnecessary.

BACKGROUND

Detergent tablets are known in the art and can provide significant advantages to the consumer compared with conventional powder detergents. However, it is highly desirable to provide an effervescent detergent tablet that is a complete washing solution, portable, and robust formulated with detergent, softener, microbial and enzymatic technology containing active oxygen thereby making the removal of stains easy while not requiring any rinsing. Detergent tablets are usually focused at the home market, designed to be used primarily in washing machines along with many different products. The present invention comprises all the characteristics of a complete washing solution for clothes without the need of a washing machine or rinsing.

BRIEF SUMMARY

The above-recited needs being addressed with an exemplary embodiment of a detergent tablet that includes a microbial and enzymatic technology that works together to optimize the efficiency of the detergent agents in low water temperatures and short laundry cycles while keeping the garments free of microbes through the use of biguanides. The disclosed embodiment further provides for the release of oxygen through the use of effervescent components which provides for the deep cleaning of stains using the controlled release of effervescence from the tablet. The disclosed embodiment may also include antibacterial and antifungal action as well as whitening and softening components.

In an exemplary embodiment, each detergent tablet is used in conjunction with 1500 ml of water and the clothing is immersed in the solution for 15 (fifteen) minutes.

The exemplary embodiment of a detergent tablet comprising, sodium laureth sulfate, citric acid, sodium bicarbonate, fragrance, Stepantex VT 90 (Methyl bis[ethyl (tallowate)]-2-hydroxyethyl ammonium methyl sulfate), polyhexamethylene biguanide, stearic acid, enzyme mix, silicon dioxide, Stearic Acid, Polyethylene glycol 4000, Long Brite (Disodium Distyrylbiphenyl Disulfonate and for the SPORT and ARMY versions Nabion 15 (Carbon-Disilicate co-granulate).

The present invention comes in 6 (six) different versions: ORIGINAL (regular formula), BABY (designed for baby clothes), DELICATE (designed for underwear), SPORT (designed for sportswear), ARMY (design for extra cleaning), TENNIS (designed for footwear). The main difference of each version is the quantities of each component in the formula.

BRIEF DESCRIPTION OF THE DRAWINGS

This disclosure is further described in the detailed description that follows, with reference to the drawings, in which.

DETAILED DESCRIPTION

Figure 1:
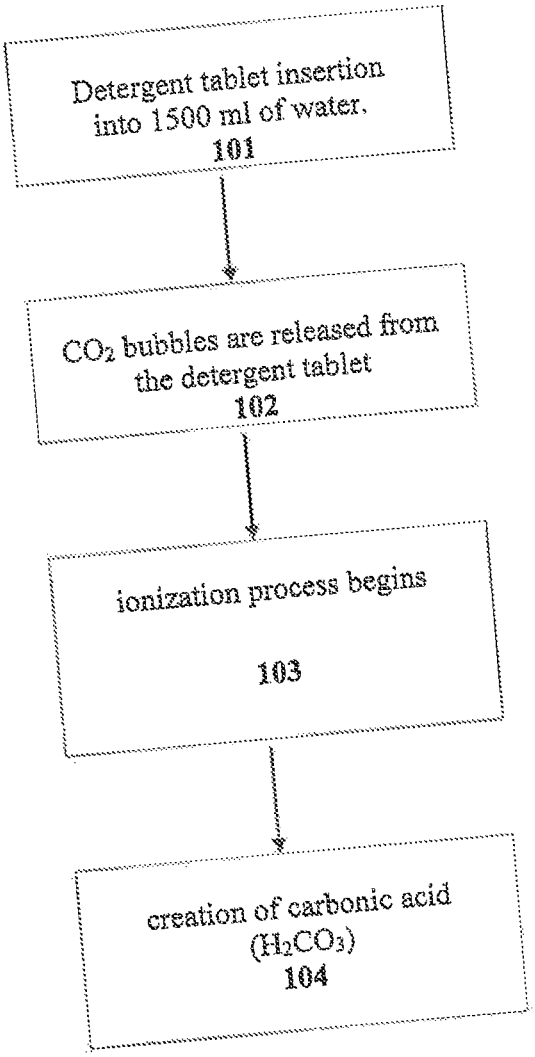
FIG. 1 is a flow chart depicting the cleaning process according to an exemplary embodiment.

An exemplary embodiment of a detergent tablet is disclosed. A detailed embodiment of the disclosed detergent tablet is disclosed herein, however it is to be understood that the disclosed embodiment is merely exemplary of the invention that may be embodied in various and alternative forms.

An exemplary embodiment of the detergent tablet is comprised of (a) an enzymatic cleaning technology, (b) an effervescent cleaning technology, (c) a bleaching and softening technology, and (d) an antimicrobial technology.

The specific components of the exemplary embodiment are calcium carbonate, sodium laureth sulfate, citric acid, sodium bicarbonate, fragrance, Stepantex VT 90 (Methyl bis[ethyl (tallowate)]-2-hydroxyethyl ammonium methyl sulfate), polyhexamethylene, biguanide (PHMB), silicon dioxide, enzymes mix, Long Brite (Disodium Distyrylbiphenyl Disulfonate) Stearic Acid, Polyethylene glycol 4000 and for the SPORT and ARMY versions Nabion 15 (Carbon-Disilicate co-granulate).

Polyethylene glycol 4000 is a polyether compound with many applications, used as an excipient.

Sodium laureth sulfate is a tensoactive, it is a powerful surfactant/detergent which allows for the actual cleaning of a garment. It also is an effective degreaser.

The combination of citric acid and sodium bicarbonate work as a carrier of other active cleaning ingredients. Organic acids and a carbonated base are the necessary components of an effervescent soap formula. Citric acid is provided as the organic acid component and sodium bicarbonate is provided as the carbonated base. When the detergent table comes into contact with water, the water breaks the acid molecules thereby creating ions. This ionization process generates carbonic acid ($H_2CO_3$) which is unstable and disperses very rapidly. The result is the creation of $CO_2$ bubbles which expel the cleaning particles and dirt from the fabric of the garment that is being washed. This process allows for a washing process without the need to rinse.

Fragrance is designed to give washed garments a fresh scent.

Stepantex VT 90 is a cationic tensoactive responsible for softening the washed garments.

PHMB (polyhexamethylene biguanide) a synthetic chemical that is part of the biguanides family and is used as an antibacterial agent.

Silicon dioxide is an anti-humectant that protects against the detergent tablet absorbing humidity from the air.

The enzyme mix is used to optimize the efficiency of the detergent agents. It allows the cleaning process to occur at low temperatures and in a short period of time. When used in detergents, enzymes facilitate the removal of stains. The enzyme mix concentration is less than 1% of the total volume and, as bio catalyzers, they are not consumed during the washing process.

Long brite (disodium distyrylbiphenyl disulfonate) is an optical bleaching agent that neutralizes yellow satins and intensifies color brightness in garments.

Stearic acid is a lubricant designed to reduce waste in the manufacturing process which assists in ensuring that the detergent tablets do not adhere to a compression machine used in the manufacturing process.

Nabion 15 is a Carbon-Disilicate co-granulate, dispersing and anti-redepositing agent in cleanser and bleach formulations. Nabion 15 is a composite of sodium carbonate and amorphous alkali metal silicate.

In FIG. 1, a flow chart depicting the cleaning process according to an exemplary embodiment is shown. As shown in FIG. 1, the washing process begins in step 101 with the insertion of a detergent tablet into 1500 ml of water.

Once the detergent tablet has been inserted into water, $CO_2$ bubbles are released from the detergent tablet in step 102.

Once $CO_2$ bubbles have been released, an ionization process begins in step 103 in which broken $CO_2$ particles release ions into the water.

Once the ionization process has occurred, the combination of released ions and water in step 104 creates an effervescent effect as a result of the creation of carbonic acid ($H_2CO_3$).

Figure 2:
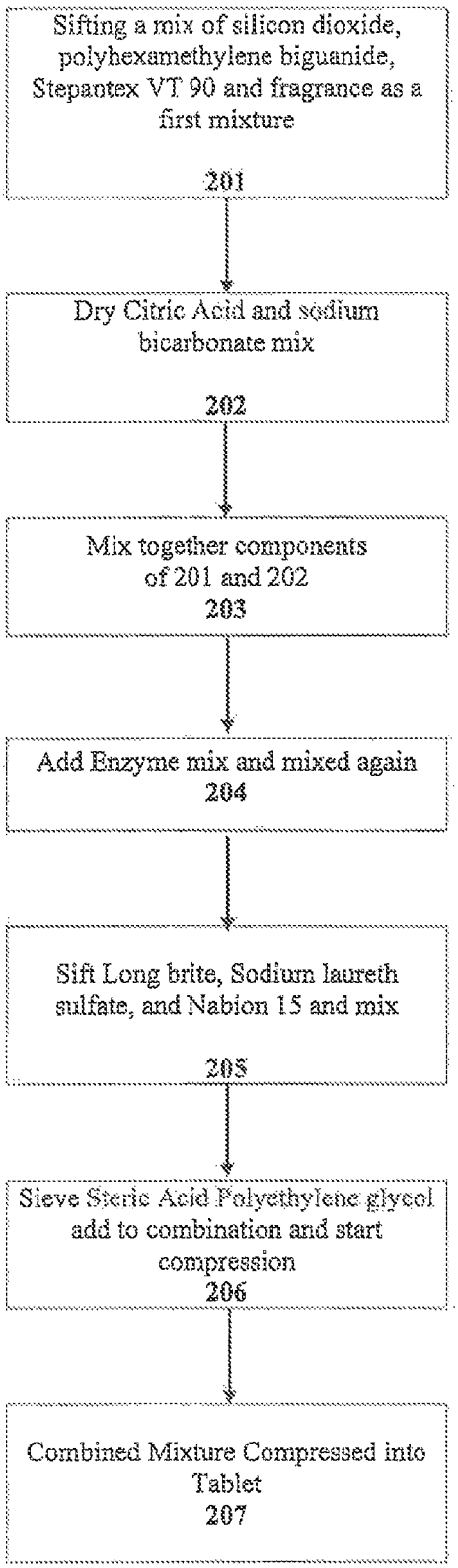
FIG. 2 is a flow chart depicting the manufacturing process according to an exemplary embodiment.

In FIG. 2, a flow chart depicting the manufacturing process according to an exemplary embodiment is shown. As shown in FIG. 2, the manufacturing process begins in step 201 with sifting a mix of silicon dioxide, polyhexamethylene biguanide, Stepantex VT 90 (Methyl bis[ethyl (tallowate)]-2-hydroxyethyl ammonium methyl sulfate) and fragrance through a 1 mm sieve.

Once the above mix has been sifted, we dry a mix the Citric Acid and the sodium bicarbonate for 10 minutes at 50 (fifty) degrees celcius in step 202.

Once the steps 201 and 202 are finished we mix their combination in step 203.

Once step 203 is finished the Enzyme mix is added and mixed again in step 204.

Once the mix in step 204 is ready we sift the Long brite (disodium distyrylbiphenyl disulfonate), the Sodium laureth sulfate and the Nabion 15 (Carbon-Disilicate co-granulate), if applicable, through a 1 mm sieve and mix the combination again in step 205.

Once mixed we sieve the Stearic Acid and the Polyethylene glycol 4000 through a 1 mm sieve and add it to the combination and start compression in step 206.

In in step 207 and the resulting combination is compressed into a tablet form. In an exemplary embodiment, each of the mixture steps are mixed for a period of at least ten minutes.

In an exemplary embodiment, Table 1 below depicts the components of the ORIGINAL formula.

| Item | Description | Percentage in each tablet |
|---|---|---|
| 1 | sodium laureth sulfate | 10%-20% |
| 2 | citric acid | 25%-35% |
| 3 | sodium bicarbonate | 30%-40% |
| 4 | fragrance | 2%-6% |
| 5 | Stepantex VT 90 (Methyl bis[ethyl (tallowate)]-2-hydroxyethyl ammonium methyl sulfate) | 0.7%-1.5% |
| 6 | PHMB (polyhexamethylene biguanide) | 0.1%-0.4% |

-continued

| Item | Description | Percentage in each tablet |
|---|---|---|
| 7 | silicon dioxide | 3%-4.5% |
| 8 | enzyme mix | 0.01%-0.1% |
| 9 | Polyethylene glycol 4000 | 6%-9% |
| 10 | Long Brite (Disodium Distyrylbiphenyl Disulfonate) | 0.01%-2% |
| 11 | Stearic Acid | 0.5% to 1.5% |

In another exemplary embodiment, Table 2 below depicts the components of the BABY formula.

| Item | Description | Percentage in each tablet |
|---|---|---|
| 1 | sodium laureth sulfate | 10%-20% |
| 2 | citric acid | 25%-35% |
| 3 | sodium bicarbonate | 30%-40% |
| 4 | fragrance | 2%-6% |
| 5 | Stepantex VT 90 (Methyl bis[ethyl (tallowate)]-2-hydroxyethyl ammonium methyl sulfate) | 0.7%-1.5% |
| 6 | PHMB (polyhexamethylene biguanide) | 0.1%-0.4% |
| 7 | silicon dioxide | 3%-4.5% |
| 8 | enzyme mix | 0.01%-0.1% |
| 9 | Polyethylene glycol 4000 | 6%-9% |
| 10 | Long Brite (Disodium Distyrylbiphenyl Disulfonate) | 0.01%-2% |
| 11 | Stearic Acid | 0.5% to 1.5% |

In another exemplary embodiment, Table 3 below depicts the components of the DELICATE formula.

| Item | Description | Percentage in each tablet |
|---|---|---|
| 1 | sodium laureth sulfate | 10%-20% |
| 2 | citric acid | 25%-35% |
| 3 | sodium bicarbonate | 30%-40% |
| 4 | fragrance | 2%-6% |
| 5 | Stepantex VT 90 (Methyl bis[ethyl (tallowate)]-2-hydroxyethyl ammonium methyl sulfate) | 0.7%-1.5% |
| 6 | PHMB (polyhexamethylene biguanide) | 0.1%-0.4% |
| 7 | silicon dioxide | 3%-4.5% |
| 8 | enzyme mix | 0.01%-0.1% |
| 9 | Polyethylene glycol 4000 | 6%-9% |
| 10 | Long Brite (Disodium Distyrylbiphenyl Disulfonate) | 0.01%-2% |
| 11 | Stearic Acid | 0.5% to 1.5% |

In another exemplary embodiment, Table 4 below depicts the components of the ARMY formula.

| Item | Description | Percentage in each tablet |
|---|---|---|
| 1 | sodium laureth sulfate | 10%-20% |
| 2 | citric acid | 25%-35% |
| 3 | sodium bicarbonate | 30%-40% |
| 4 | fragrance | 2%-6% |
| 5 | Stepantex VT 90 (Methyl bis[ethyl (tallowate)]-2-hydroxyethyl ammonium methyl sulfate) | 0.7%-1.5% |
| 6 | PHMB (polyhexamethylene biguanide) | 0.1%-0.4% |
| 7 | silicon dioxide | 3%-4.5% |
| 8 | enzyme mix | 0.01%-0.1% |
| 9 | Polyethylene glycol 4000 | 6%-9% |
| 10 | Long Brite (Disodium Distyrylbiphenyl Disulfonate) | 0.01%-2% |
| 11 | Stearic Acid | 0.5% to 1.5% |
| 12 | Nabion 15 (Carbon-Disilicate co- granulate) | 1% to 3% |

In another exemplary embodiment, Table 5 below depicts the components of the SPORT formula.

| Item | Description | Percentage in each tablet |
|---|---|---|
| 1 | sodium laureth sulfate | 10%-20% |
| 2 | citric acid | 25%-35% |
| 3 | sodium bicarbonate | 30%-40% |
| 4 | fragrance | 2%-6% |
| 5 | Stepantex VT 90 (Methyl bis[ethyl (tallowate)]-2-hydroxyethyl ammonium methyl sulfate) | 0.7%-1.5% |
| 6 | PHMB (polyhexamethylene biguanide) | 0.1%-0.4% |
| 7 | silicon dioxide | 3%-4.5% |
| 8 | enzyme mix | 0.01%-0.1% |
| 9 | Polyethylene glycol 4000 | 6%-9% |
| 10 | Long Brite (Disodium Distyrylbiphenyl Disulfonate) | 0.01%-2% |
| 11 | Stearic Acid | 0.5% to 1.5% |
| 12 | Nabion 15 (Carbon-Disilicate co- granulate) | 1% to 3% |

In another exemplary embodiment, Table 6 below depicts the components of the TENNIS formula.

| Item | Description | Percentage in each tablet |
|---|---|---|
| 1 | sodium laureth sulfate | 10%-20% |
| 2 | citric acid | 25%-35% |
| 3 | sodium bicarbonate | 30%-40% |
| 4 | fragrance | 2%-6% |
| 5 | Stepantex VT 90 (Methyl bis[ethyl (tallowate)]-2-hydroxyethyl ammonium methyl sulfate) | 0.7%-1.5% |
| 6 | PHMB (polyhexamethylene biguanide) | 0.1%-0.4% |
| 7 | silicon dioxide | 3%-4.5% |
| 8 | enzyme mix | 0.01%-0.1% |
| 9 | Polyethylene glycol 4000 | 6%-9% |
| 10 | Long Brite (Disodium Distyrylbiphenyl Disulfonate) | 0.01%-2% |

Although exemplary embodiments of the present invention have been shown and described, it will be apparent to those having ordinary skill in the art that a number of changes, modifications or alterations to the invention described herein may be made, none of which depart from the spirit of the present invention. All such changes, modifications, and alterations should therefore be seen as being within the scope of the present invention.

It should be appreciated that the present invention provides a substantial advance in the manufacture and storage of effervescent type formulations, providing all of the herein-described advantages without incurring any relative disadvantages.

The terms "comprise", "comprises" and "comprising", as used herein, are used in the inclusive sense of "having", or "including", and not in the exclusive sense of "consisting only of".

What is claimed is:

1. An effervescent detergent tablet, comprising:

a) from 10% to 20% of sodium laureth sulfate;

b) from 25% to 35% of citric acid;

c) from 30% to 40% of sodium bicarbonate;

d) less than 0.1% of enzyme mix;

e) from 2% to 6% of fragrance;

f) from 0.7% to 1.5% (Methyl bis[ethyl (tallowate)]-2-hydroxyethyl ammonium methyl sulfate);

g) from 0.1% to 0.4% of polyhexamethylene biguanide;

h) from 3% to 4.5% of silicon dioxide;

i) from 0.1% to 2% of Disodium Distyrylbiphenyl Disulfonate; and j) from 6% to 9% of Polyethylene glycol 4000, wherein the Polyethylene glycol 4000 is a polyethylene glycol having an average molecular weight of 4,000 g/mol.

2. The tablet of claim 1, further comprising from 0.5% to 1.5% of Stearic Acid.

3. The tablet of claim 2, further comprising from 1% to 3% of carbon-disilicate co-granulate.

4. A method of producing effervescent detergent tablets, said method comprising the steps of:

a) sifting a mix of silicon dioxide, polyhexamethylene biguanide, Methyl bis[ethyl (tallowate)]-2-hydroxyethyl ammonium methyl sulfate and fragrance through a 1 mm sieve to homogenize a first mixture;

b) drying Citric acid and sodium bicarbonate and adding to the first mixture, and mixing the first mixture to homogenize the first mixture;

c) adding an Enzyme Mix, and mixing the first mixture to homogenize the first mixture;

d) sifting Disodium Distyrylbiphenyl Disulfonate, and Sodium Laureth Sulfate through a 1 mm sieve and adding to the first mixture, and mixing the first mixture to homogenize the first mixture;

e) sifting Stearic Acid and Polyethylene glycol 4000 through a 1 mm sieve and mixing to the first mixture to homogenize the first mixture; and f) forming the combined mixture into tablets.

5. A method according to claim 4, wherein carbon-disilicate co-granulate is sifted with the Disodium Distyrylbiphenyl Disulfonate and the Sodium Laureth Sulfate.

6. A method according to claim 4, wherein each of the steps of mixing comprises mixing for at least ten minutes.

* * * * *